US005543606A

United States Patent [19]

Gics

[11] Patent Number: 5,543,606

[45] Date of Patent: *Aug. 6, 1996

[54] NON-CIRCULAR OVENABLE FOOD PACKAGE HAVING A BASE WITH DEPENDING LEG MEMBERS AND AT LEAST ONE RAISED PORTION AND ASSOCIATED FOOD PACKAGE

[75] Inventor: Paul W. Gics, Sewickley Heights, Pa.

[73] Assignee: Gics & Vermee, L.P., Sewickley Heights, Pa.

[ * ] Notice: The term of this patent shall not extend beyond the expiration date of Pat. No. 5,484,984.

[21] Appl. No.: 285,249

[22] Filed: Aug. 3, 1994

Related U.S. Application Data

[63] Continuation-in-part of Ser. No. 206,564, Mar. 4, 1994, Pat. No. 5,484,984.

[51] Int. Cl.[6] ..... H05B 6/80

[52] U.S. Cl. ..... 219/730; 219/732; 219/734; 426/107; 426/234; 99/DIG. 14

[58] Field of Search ..... 219/730, 732, 219/733, 734, 735; 99/DIG. 14; 426/107, 110, 111, 113, 234, 243; 229/901, 902, 125.25, 125.26, 125.27

[56] References Cited

U.S. PATENT DOCUMENTS

| | | | |
|---|---|---|---|
| 3,372,856 | 3/1968 | Erhart et al. . | |
| 3,495,758 | 2/1970 | Wienecke, Jr. . | |
| 3,785,544 | 1/1974 | Smith . | |
| 4,257,530 | 3/1981 | Faller . | |
| 4,260,060 | 4/1981 | Faller | 219/732 |
| 4,286,136 | 8/1981 | Mason, Jr. | 219/732 |
| 4,373,636 | 2/1984 | Hoffman . | |
| 4,398,077 | 8/1983 | Freedman et al. | 219/734 |
| 4,676,857 | 6/1987 | Scharr et al. . | |
| 4,763,790 | 8/1988 | McGechins . | |
| 4,794,005 | 12/1988 | Swiontek | 426/107 |
| 4,841,112 | 6/1989 | Peleg | 219/730 |
| 4,870,233 | 9/1989 | McDonald et al. | 219/730 |
| 4,916,280 | 4/1990 | Havette | 219/732 |
| 4,917,748 | 4/1990 | Harrison . | |
| 4,939,332 | 7/1990 | Hahn | 219/734 |
| 4,994,638 | 2/1991 | Iorns et al. | 219/734 |
| 5,039,833 | 8/1991 | Woods . | |
| 5,090,615 | 2/1992 | Hopkins et al. . | |
| 5,234,159 | 8/1993 | Lorence et al. . | |
| 5,310,977 | 5/1994 | Stenkamp et al. | 219/730 |
| 5,352,465 | 10/1994 | Gondek et al. | 219/730 |

FOREIGN PATENT DOCUMENTS

| | | |
|---|---|---|
| 0276654 | 8/1988 | European Pat. Off. . |
| 0327243 | 8/1989 | European Pat. Off. . |
| 039981 | 11/1990 | European Pat. Off. . |
| 0492052 | 7/1992 | European Pat. Off. . |
| 2164868 | 8/1973 | France . |
| 2629424 | 10/1989 | France . |
| 2046060 | 5/1983 | United Kingdom . |
| 8604880 | 8/1986 | WIPO . |
| 8805249 | 7/1988 | WIPO . |
| 9105448 | 4/1991 | WIPO . |

*Primary Examiner*—Philip H. Leung
*Attorney, Agent, or Firm*—David V. Radack; Eckert Seamans Cherin & Mellott

[57] ABSTRACT

An ovenable food package including a non-circular base having legs extending therefrom. The base is constructed and arranged such that an exterior gap is created between a portion of the base and the support surface of a food heating apparatus into which the package is placed. The base is also constructed and arranged such that at least one interior gap is created between the food product contained in the package and the base when the food product rests on the base. This construction and arrangement insures uniform and efficient heating of the food product and also insures that moisture in the form of steam can escape from the food product so that the food product comes out of the oven crispy and not soggy. An ovenable food package is also disclosed that has a sidewall extending from the base that terminates in a stepped flange and a removable lid for covering the base. The lid is sized and shaped such that a removable portion of the lid can be positioned to rest on the stepped flange. In this way, a space is created between the lid and the food product.

11 Claims, 11 Drawing Sheets

NON-CIRCULAR OVENABLE FOOD PACKAGE HAVING A BASE WITH DEPENDING LEG MEMBERS AND AT LEAST ONE RAISED PORTION AND ASSOCIATED FOOD PACKAGE

CROSS-REFERENCE TO RELATED APPLICATION

This application is a continuation-in-part of United States patent application Ser. No. 08/206,564, filed Mar. 4, 1994 now U.S. Pat. No. 5,434,934.

BACKGROUND OF THE INVENTION

This invention relates to a food package that can be placed directly in a conventional or microwave oven along with the food product which is packaged therein.

Packaged foods, such as packaged frozen foods, are manufactured and sold extensively throughout the United States and the world. These foods offer the consumer a convenient alternative to preparing foods from "scratch". For example, frozen pizzas are sold which, typically, are packaged with a paperboard base and shrink wrapping. These pizzas can be placed either in a conventional oven or a microwave oven. When it is desired to heat the pizza in a conventional oven, the shrink wrapping and the paperboard base are removed and discarded and the frozen pizza is placed on a cookie sheet or aluminum foil and then placed into the conventional oven.

For microwave frozen pizzas, it is known to provide a package consisting of a box which contains the frozen pizza. The box includes microwave susceptor material. In use, the box is opened and placed in the microwave oven along with the pizza and then subjected to microwave energy.

There are several problems with current ovenable food packages. For microwavable food packages, if the package rests on a part of the oven which acts as a heat sink to conduct heat away heat from the receptor material, it takes longer to heat the food product than should be necessary. Also, the food product tends to be heated non-uniformly, thus causing "cold spots" in the food product. Another major problem with many microwavable food packages is that moisture contained in the food product causes steam, and this steam must escape the product in order to avoid sogginess. In many "closed packages" the steam cannot escape. Finally, and especially for microwavable frozen pizzas, the cheese toppings can melt and overflow over the sides of the crust and under the crust causing sticking Of the pizza to the package, a phenomenon known in the trade as "wicking".

The above problems are also present with other microwavable food products such as french fries, pocket sandwiches, pies and bakery products. In addition, food manufacturers, because of the above problems, have not made other microwavable food products that could be made and marketed if the above problems were not present.

What is needed, therefore, is an ovenable food package that can be placed into a conventional or microwave oven along with the food product desired to be cooked. The ovenable food package needed not only must facilitate uniform and efficient heating of the food product, but also must be constructed and arranged such that sogginess of the cooked food product is avoided.

SUMMARY OF THE INVENTION

The invention has met the above needs. The ovenable food package includes a non-circular base having leg members extending therefrom. The base is constructed and arranged such that a gap is created between a portion of the base and the support surface of an oven (conventional or microwave) when the base is placed on the support surface. Preferably, the leg members extend from each of the corners of the base to maximize the surface area of the base which is spaced from the support surface. The base is also constructed and arranged such that at least one interior gap is created between the food product and the base when the food product rests on the base. This construction and arrangement insures uniform and efficient heating of the food product and also insures that moisture in the form of steam can escape from the food product so that the food product comes out of the oven crispy and not soggy.

In a preferred further embodiment, the package includes a sidewall extending from the base that terminates in a stepped flange and a lid for covering the base. At least a portion of the lid is removable from the package, the removable portion being sized and shaped such that it can be positioned to rest on portions of the stepped flange. In this way, a space is created between the lid and the food product.

BRIEF DESCRIPTION OF THE DRAWINGS

A full understanding of the invention can be gained from the following description of the preferred embodiment when read in conjunction with the accompanying drawings in which.

DETAILED DESCRIPTION

Figure 1:
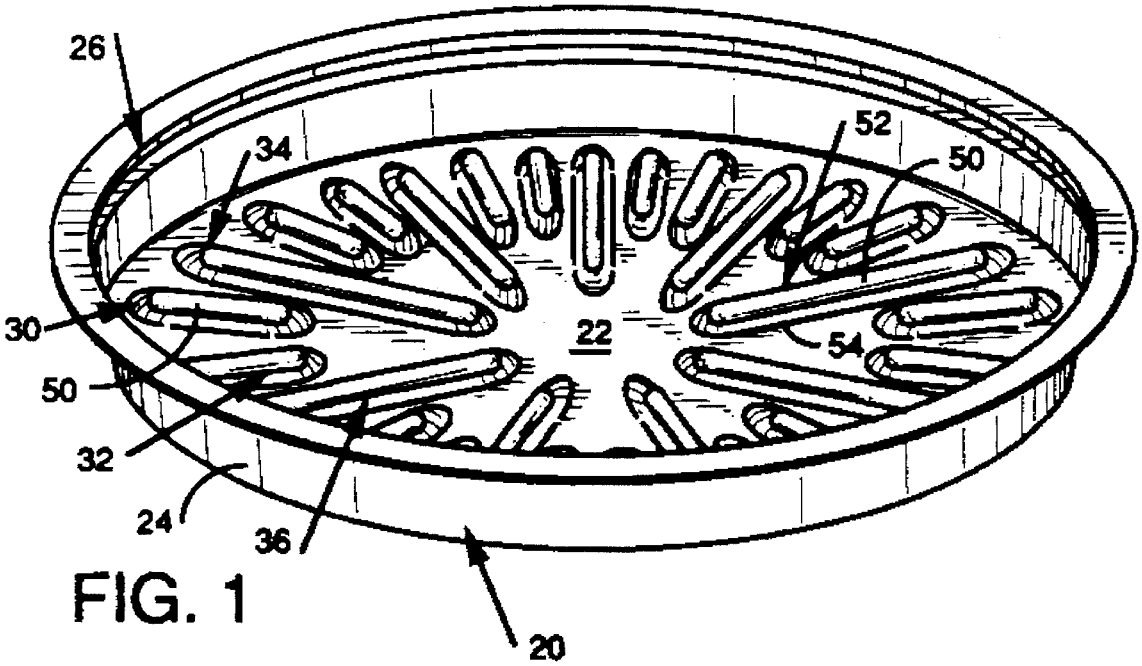
FIG. 1 is a perspective view of an ovenable food package.
Figure 2:
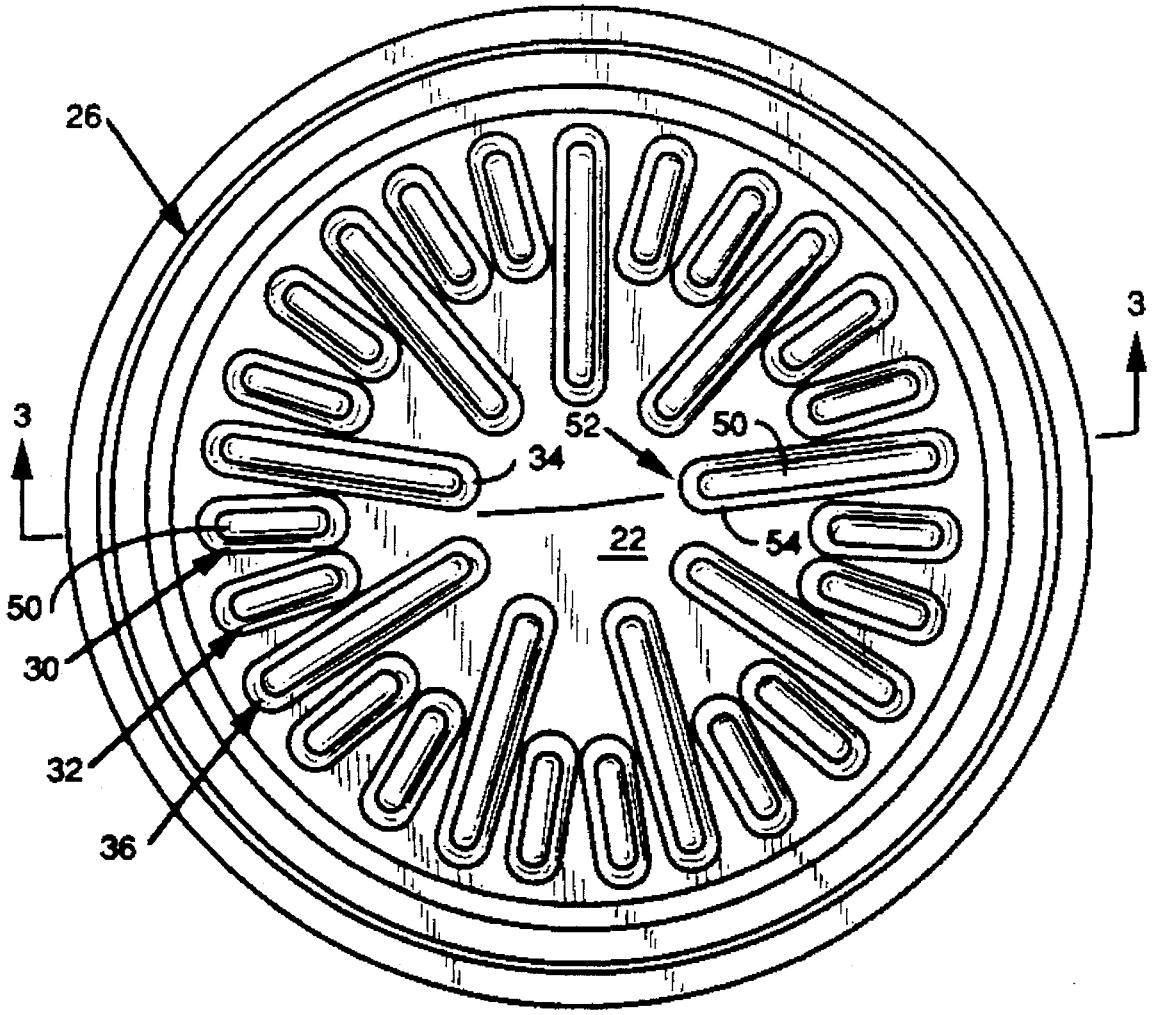
FIG. 2 is a top plan view of the package of FIG. 1.
Figure 3:
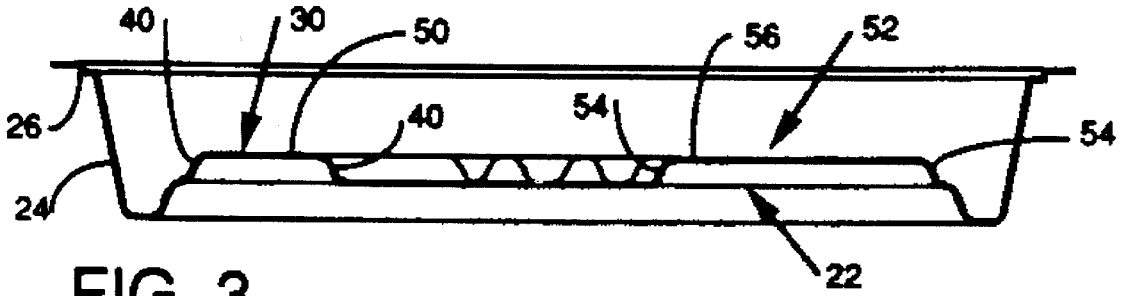
FIG. 3 is a sectional view taken through line 3—3 of FIG. 2.

Referring to FIGS. 1–3, an ovenable food package is shown. The package includes a base 20 which consists of a paperboard that is coated with a high temperature coating on the interior. For microwavable food packages, a microwave susceptor material (such as aluminum, alumina or carbon) is disposed between the paperboard base and the high temperature coating. The microwavable base is made by providing a web of paperboard and sputtering aluminum material thereon before the high temperature coating is applied. The material for the base can be purchased commercially from International Paper Co. Another material that can be used for the base is crystalized polyethylene terephthalate (hereinafter referred to as "C-PETE").

The flat material is constructed and arranged to have the general shape shown in FIGS. 1–3. This is done by using conventional die cutting techniques well known to those skilled in the art. It will be appreciated that the exact size of the base 20, as well as the shape and dimension of the various sections of the base 20 can vary, just as long as the general function and the general construction and arrangement of the base 20 (as will be discussed below) is preserved. It will also be appreciated that even though an ovenable pizza package is shown, the general concepts of the invention apply equally to other ovenable food products such as, for example, french fries, pocket sandwiches, pies and bakery products that come in packages having circular, oval, rectangular, triangular or square shapes.

The base consists of a floor portion 22 and a sidewall portion 24 that extends upwardly from the floor portion 22. The sidewall portion 24 terminates in a stepped flange member 26. The stepped flange member 26 is used to secure a cover means to the base 20, as will be discussed below.

The base 20 has integrally formed therein a plurality of raised ovals with two smaller ovals such as ovals 30, 32 being sandwiched by two larger ovals 34, 36 with this pattern being repeated around the base 20. The ovals, such as oval 30 has sidewall 40 (FIG. 3) that extends upwardly and inwardly from the floor portion 22 of the base 20 and then terminates in a central plateau 50. Similarly, larger oval 52 is raised from floor 22 and has a sidewall 54 that extends upwardly and inwardly from the floor portion 22 of the base 20 and then terminates in a central plateau 56.

Figure 4:
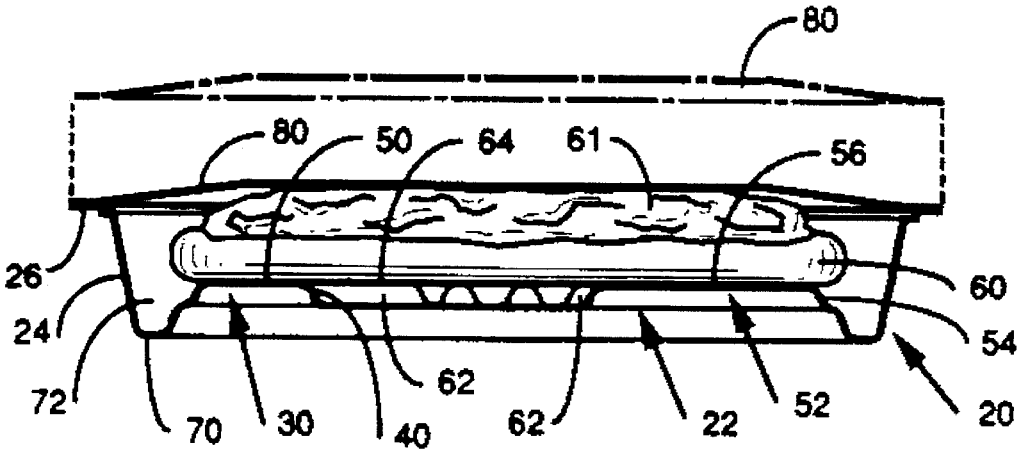
FIG. 4 is a vertical section showing a pizza resting on the package with a lid means disposed thereon.

Referring now to FIG. 4, the base 20 is shown with a frozen pizza 60 having toppings 61 placed thereon. The pizza 60 is supported on the plateaus of the ovals, such as plateaus 50 and 56 as shown in FIG. 4. It will be appreciated that an interior gap 62 is maintained between the bottom portion of the pizza crust 64 and the floor portion 22 of the base 20. In addition, the base includes an outer circumferential leg portion 70 defined by the sidewall 24 and the floor portion 22. The leg portion 70 defines a collection reservoir 72 which serves the dual purpose of collecting any loose toppings 61 from the pizza 60 and also any melted cheese that cascades over the side of the pizza 60 while the pizza 60 is cooking. This latter function will prevent "wicking" which is when melted cheese comes between the pizza crust 64 and the floor portion 22 and thus causing sticking of the pizza crust 64 to the floor portion 22.

FIG. 4 also shows lid 80 in phantom line drawing and in full line drawing. The full line drawing shows the lid being placed on the flange portion 26 of the base 20. It will be appreciated that the base is dimensioned such that the top of the pizza 60 (the portion containing the toppings 61) extends above the flange portion 26 as shown in FIG. 4. The lid 80, which can be made of paperboard, is resilient and thus can bow in the middle as is shown in FIG. 4 and preferably contacts the toppings 61 on the pizza 60. In addition, the flange portion 26 can also bend to facilitate the bowing of the lid 80, by being pivotable with respect to the sidewall 24. This will resist the toppings 61 from becoming dislodged from the pizza 60 after packing of the pizza 60, during shipment of the pizza 60 from the manufacturer to the grocery store and finally during transportation of the pizza 60 from the grocery store to the end use environment.

It will be appreciated that other covering means, such as shrink wraps, can be used for packing the pizza. In use, the lid 80, or other cover means, is removed and discarded by the consumer and the pizza 60 is placed directly into the microwave or conventional oven along with the base 20.

Figure 5:
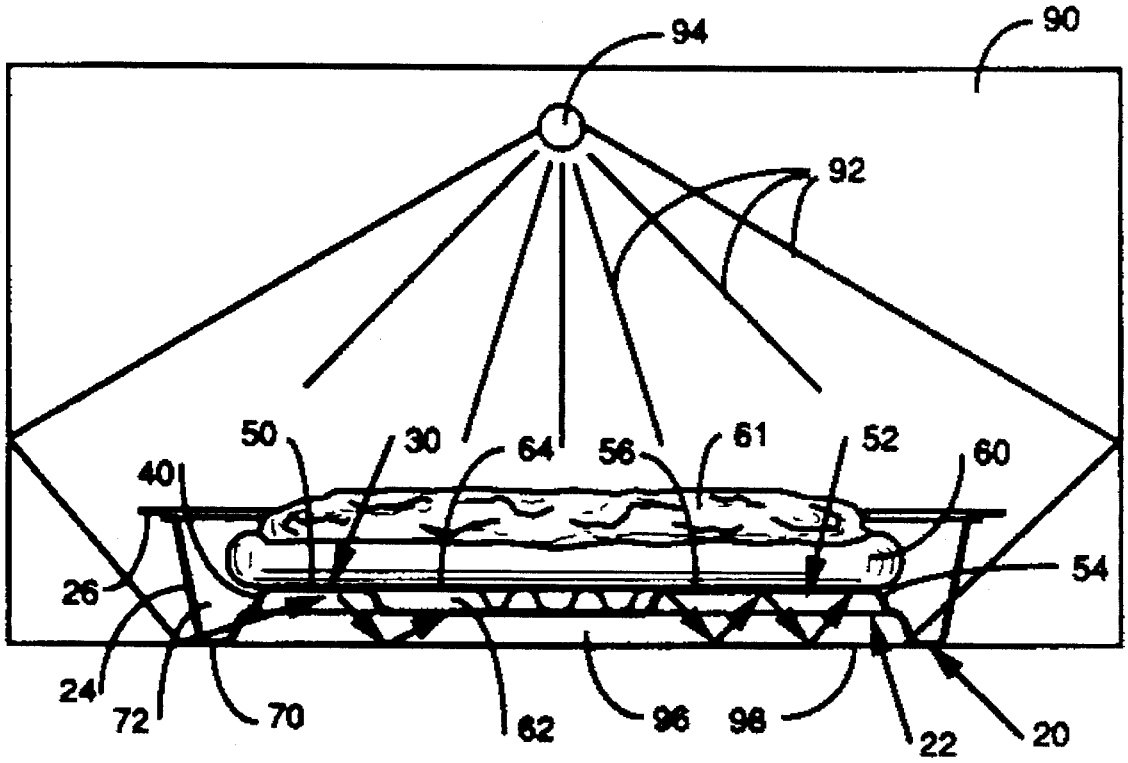
FIG. 5 is a vertical section showing the package of FIG. 1 with a pizza resting thereon with both the pizza and the package being placed in a microwave oven.

Referring to FIG. 5, the base 20 with pizza 60 thereon is shown as placed in a microwave oven 90. The microwaves 92 from microwave source 94 heat the pizza 60. The base 20 is constructed and arranged such that an exterior gap 96 is formed between the base 20 and the support on which the base 20 rests when the pizza 60 is being cooked, which in this case is the floor 98 of the microwave oven 90. In this way, the base 20 and the floor 98 do not act as heat sink to draw away the heat created by the microwaves 92 in cooking the pizza 60. This leads to uniform heating of the entire pizza and also the elimination of so-called "cold spots" in the pizza.

It will also be appreciated that the interior gaps 62 created between the pizza 60 and the base also enhance the uniform heating of the pizza. Furthermore, the steam created by moisture in the frozen pizza which is heated is able to be vented from the bottom of the pizza 60 thus preventing sogginess of the pizza and creating a crispy crust. This steam also creates a "steam blanket" that enhances melting of the cheese on top of the pizza 60. In effect, the package acts as a small baking oven.

Figure 6:
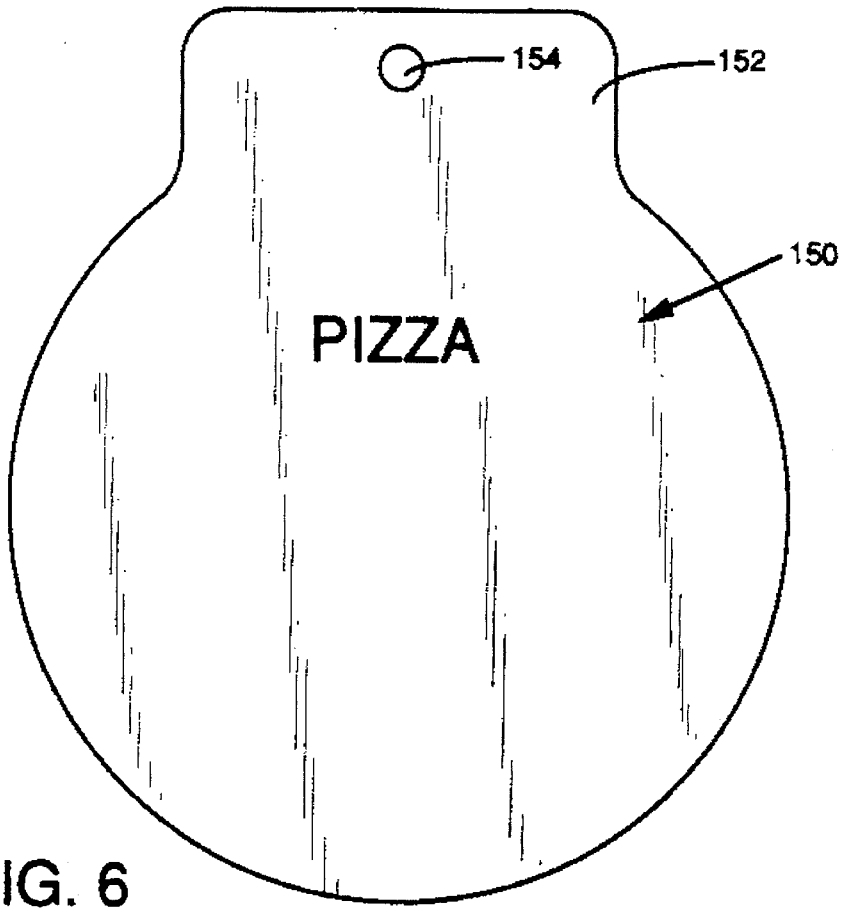
FIG. 6 is a top plan view of a peggable lid for the food package.
Figure 7:
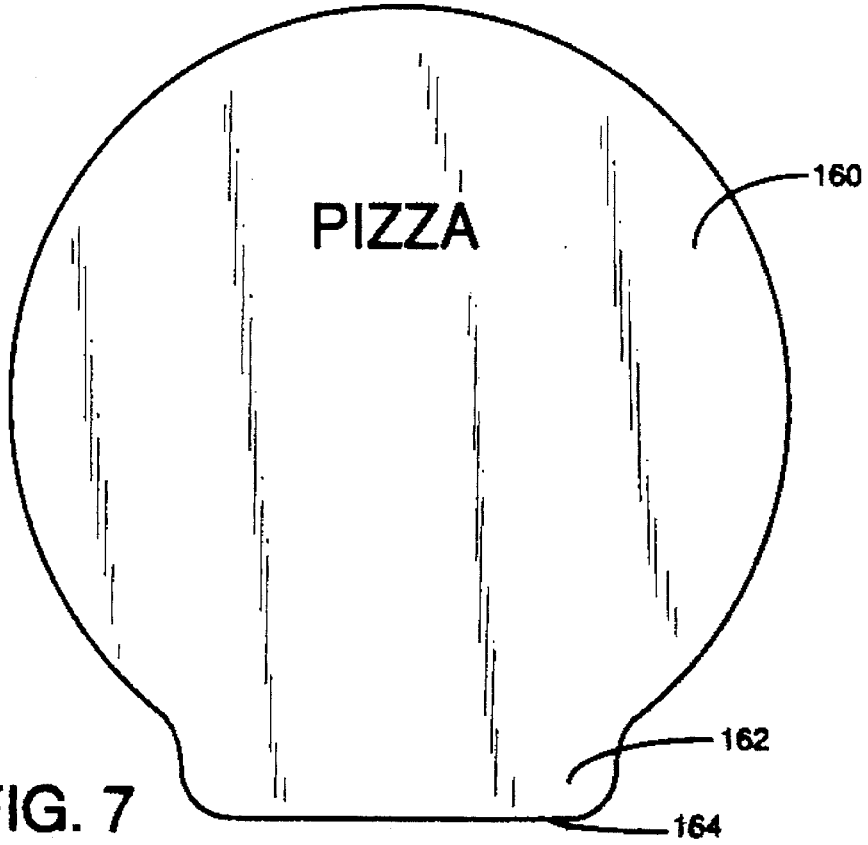
FIG. 7 is a top plan view of a lid having support means so that the food package can stand upright.
Figure 8:
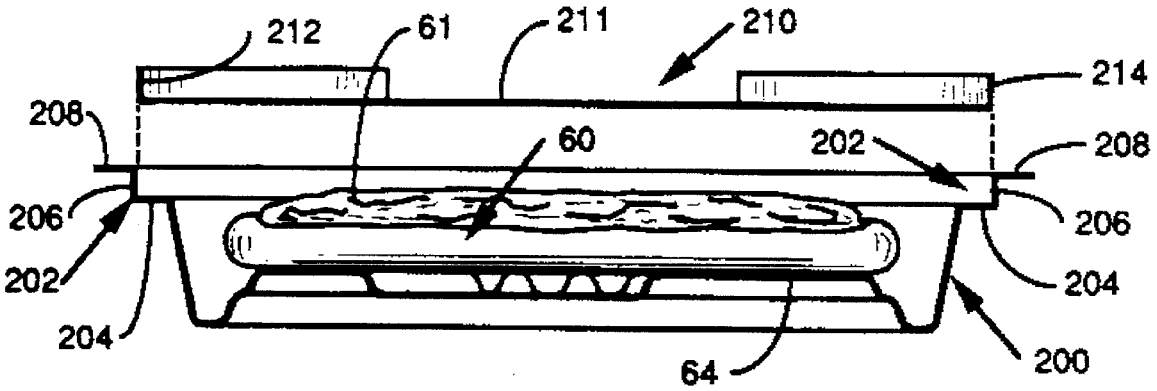
FIG. 8 is a cross-sectional view of another embodiment of a food package.

FIGS. 6 and 7 show two different embodiments for paperboard lids that can be used in association with the base 20 of the invention. FIG. 6 shows a peggable lid 150, in which the lid has a flange portion 152 defining a peg hole 154. These lids can be used in association with pegs provided in the grocer's freezer so that the pizza package is displayed in an upright manner. This provides a neat and attractive method of displaying the pizza package.

FIG. 7 shows a standable lid 160 in which a flange 162 is provided that is adapted to having the bottom edge 164 act as a stand so that the pizza package again can stand in an upright manner.

Figure 9:
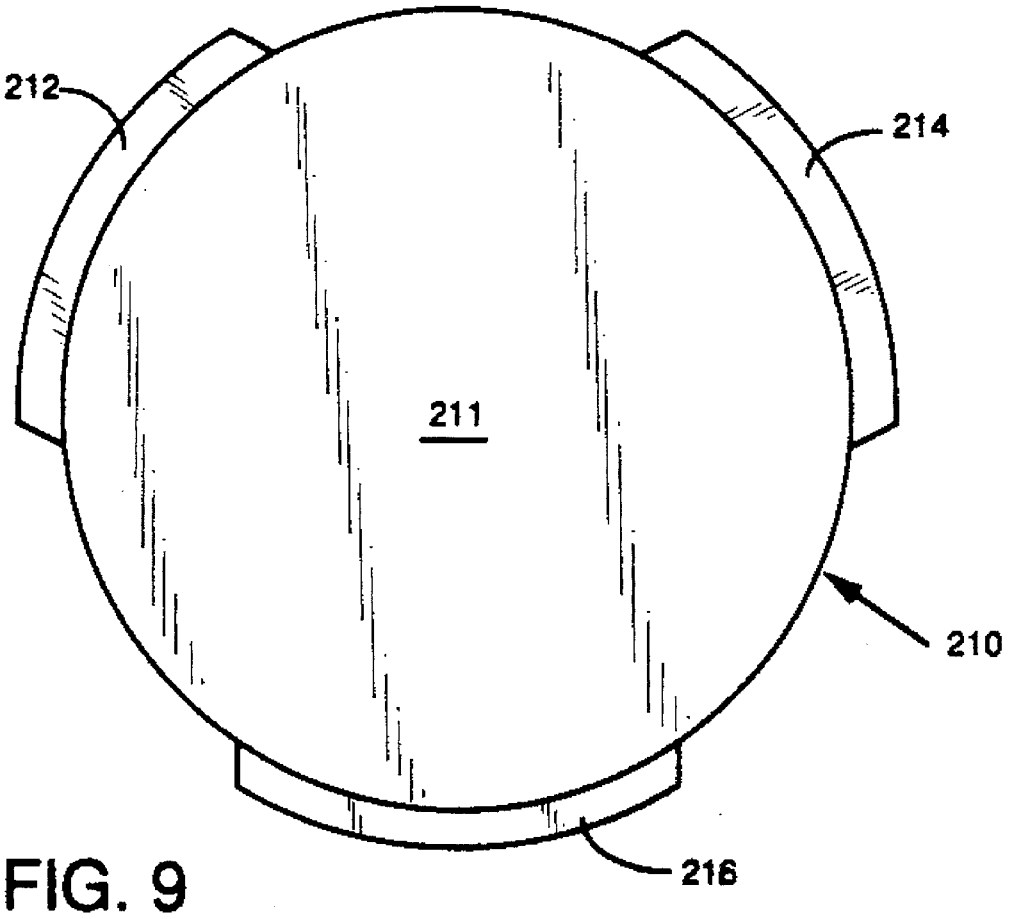
FIG. 9 is a top plan view of the lid of the embodiment shown in FIG. 8 with the flaps extended.
Figure 10:
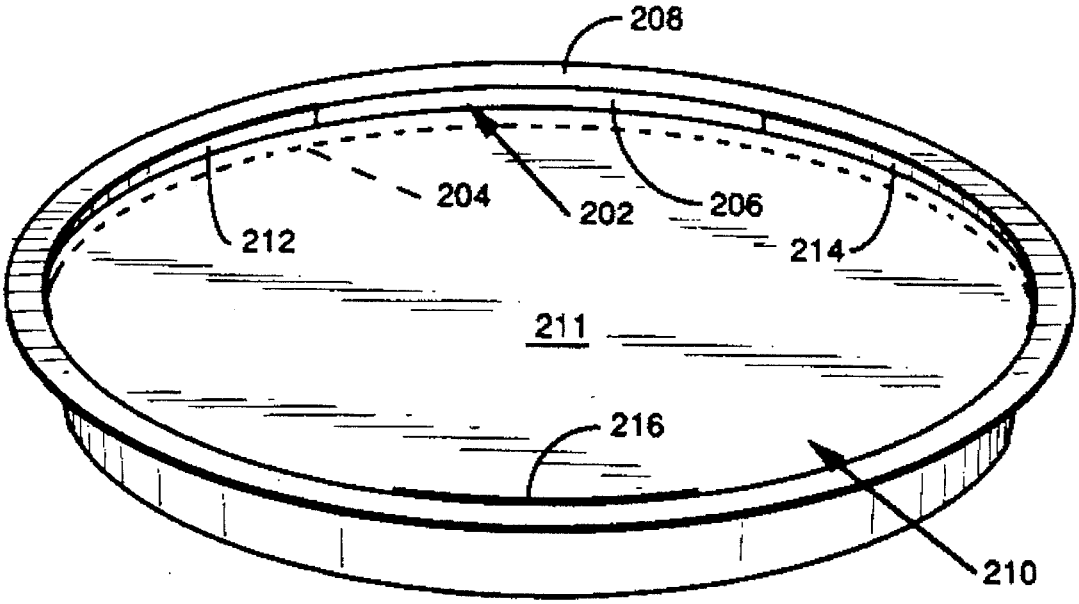
FIG. 10 is a detailed perspective view of the assembled food package of FIG. 8 showing the lid being in position on the base.
Figure 11:
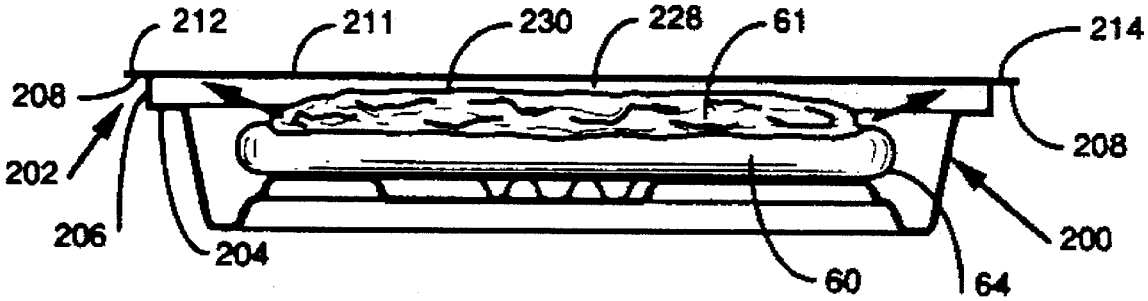
FIG. 11 is a view similar to the view of FIG. 8 only showing the lid removed and replaced on top of the sidewall of the base of the food package.

FIGS. 8–11 illustrate another embodiment of the ovenable food package of the invention. In this embodiment a base 200, similar in construction and arrangement to base 20, is provided. This base 200, however, is provided with a step flange 202 having a lower horizontal portion 204, a vertical portion 206 and an upper horizontal portion 208. The lid 210, as shown in FIG. 9, has a central portion 211 and three flange portions 212, 214, 216 extending from the main body thereof. As can best be seen in FIG. 10, the flange portions 212, 214, 216 are folded upwardly and are disposed in step flange 202. When it is desired to cook the pizza 60, the lid 210 is removed from the base 200, and the flange portions 212, 214, 216 are unfolded so that they are co-planar with central portion 211 of the lid 210 (as shown in FIG. 9). At that point, the lid 210 is placed back on the base 200, with flange portions only being supported by the horizontal upper portion 208 of the step flange 220. As shown in FIG. 11, this creates a space 228 between the top of the pizza 230 and the lid 210. This will act to vent the steam and also to use the steam to effectively heat the toppings 61 on the pizza 60. The steam forms a "steam blanket" in the space 228 which enhances melting of the cheese on top of the pizza 230.

Figure 12:
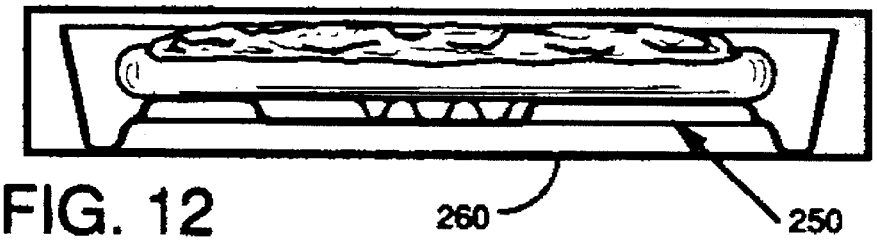
FIG. 12 is a vertical section of yet another embodiment of a food package.

FIG. 12 shows yet another embodiment in which the base 250 (similar in construction and arrangement to base 20 and 200) having pizza 60 disposed thereon (the cover means is not shown) being contained in an outer box 260. The outer box 260 acts to trap the steam created when cooking the pizza, similarly to lid 210.

Referring now to FIGS. 13–20, yet another embodiment of an ovenable food package made in accordance with the invention is shown. This package 300 includes a non-circular base 302, which as is shown in FIGS. 13–20 is in the form of a square. The base 302 can be made from paperboard that is coated with a high temperature coating on the interior. For microwavable food packages, a microwave susceptor material (such as aluminum, alumina or carbon) is disposed between the paperboard base and the high temperature coating.

The base 302 can also be made of C-PETE which has a microwave susceptor material, such as aluminum, alumina or carbon embedded therein. This material can be purchased commercially. It is made by providing a pair of rolls, one roll containing C-PETE sheet having disposed on one surface a layer of microwave susceptor material with a layer of adhesive placed on top of the microwave susceptor material and the second roll containing C-PETE sheet only. The sheets of the respective rolls are uncoiled and then, using the adhesive, are laminated together.

The C-PETE sheet having the microwave susceptor embedded therein is then coiled onto another roll for the forming operation. The forming operation, as also known to those skilled in the art, is preferably a vacuum die forming process in which the C-PETE sheet having the microwave susceptor embedded therein is first heated to make it pliable and then sucked into a die cavity having the shape of the final package which is to be formed. Upon cooling, the formed package (such as base 302) is ejected from the die cavity and is then ready to be filled with the food product. It will be appreciated that the base 302 shown in FIGS. 13–20, as well as the base 20 shown in FIGS. 1–12 can be manufactured by the method set forth above, however, the inventions disclosed herein are not limited by the method of forming the bases 20 and 302, but instead the invention is directed to the structure of the respective bases.

Referring now again to FIGS. 13–20, the base consists of a floor portion 322 and a sidewall portion 324. The sidewall portion 324 terminates in a stepped flange 326, consisting of a horizontal portion 328 that extends generally perpendicularly from the sidewall portion 324 and a vertical portion 329 that extends generally perpendicularly from the horizontal portion 328. The vertical portion 329 terminates in a free edge 329*a*.

The base 302 has integrally formed therein a plurality of raised ovals with two smaller ovals such as ovals 330, 332 being sandwiched by two larger ovals 334, 336 with this pattern being repeated around the base 302. The ovals, such as larger oval 334 has sidewall 340 (FIG. 16) that extends upwardly and inwardly from the floor portion 322 of the base 302 and then terminates in a central plateau 350. Similarly, smaller oval 352 is raised from floor 322 and has a sidewall 354 that extends upwardly and inwardly from the floor portion 322 of the base 302 and terminates in a central plateau 356.

Although the ovals are shown having a central plateau, it will be appreciated that the upper portion of the oval can be rounded or can form any other shape (such as coming to a point) and still be considered within the scope of the invention.

Figure 17:
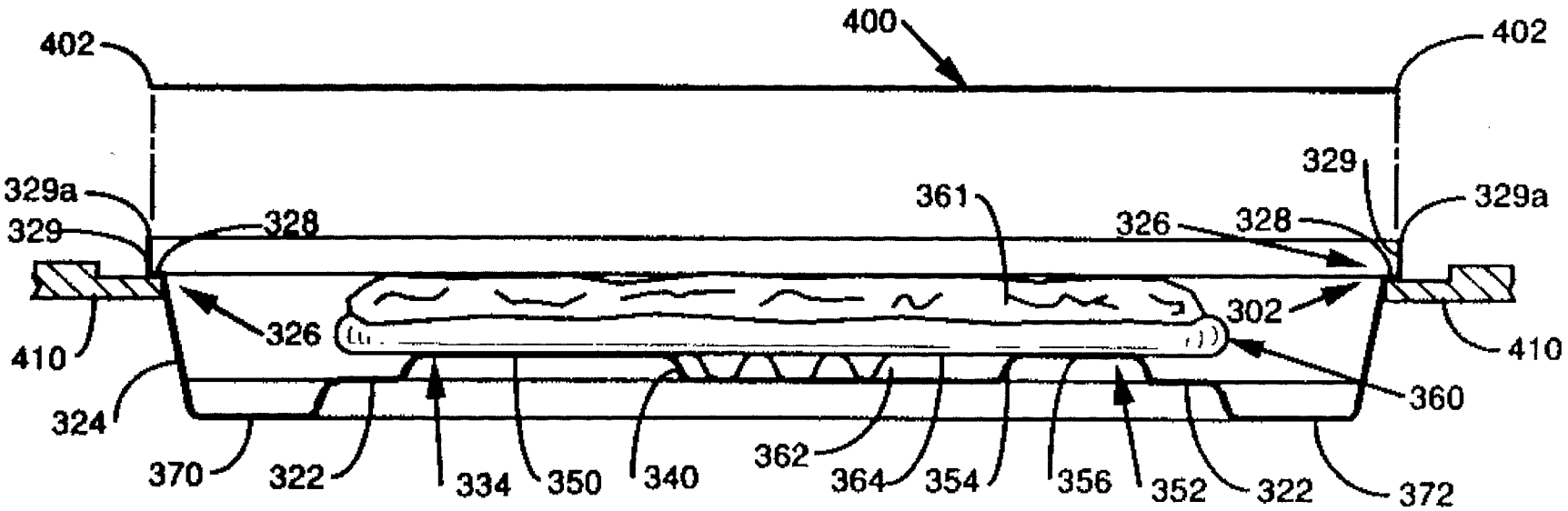
FIG. 17 is a cross-sectional view similar to FIG. 16 only showing a lid before it is placed onto the base.

Referring now to FIG. 17, the base 302 is shown with a frozen pizza 360 having toppings 361 placed thereon. The pizza 360 is supported on the plateaus of the ovals, such as plateaus 350 and 356 as shown in FIG. 17. It will be appreciated that an interior gap 362 is maintained between the bottom portion of the pizza crust 364 and the floor portion 322 of the base 302.

It will be appreciated that the interior gaps 362 created between the pizza 360 and the base 302 also enhance the uniform heating of the pizza 360. Furthermore, the steam created by moisture in the frozen pizza which is heated is able to be vented from the bottom of the pizza 360 thus preventing sogginess of the pizza and creating a crispy crust. This steam also creates a "steam blanket" above the pizza 360 that enhances melting of the cheese on top of the pizza 360.

It will be further appreciated that when the base 302 with pizza 360 thereon is placed in a microwave oven, such as microwave oven 90 shown in FIG. 5, an exterior gap 366 (FIG. 20) is formed between the base 302 and the support surface 368 (FIG. 20) of the microwave oven in which the pizza 360 is cooked. As with the package shown in FIGS. 1–12, the base 302 does not act as heat sink to draw away the heat created by the microwaves in cooking the pizza. This leads to uniform heating of the entire pizza 360 and also the elimination of so-called "cold spots" in the pizza 360.

Figure 13:
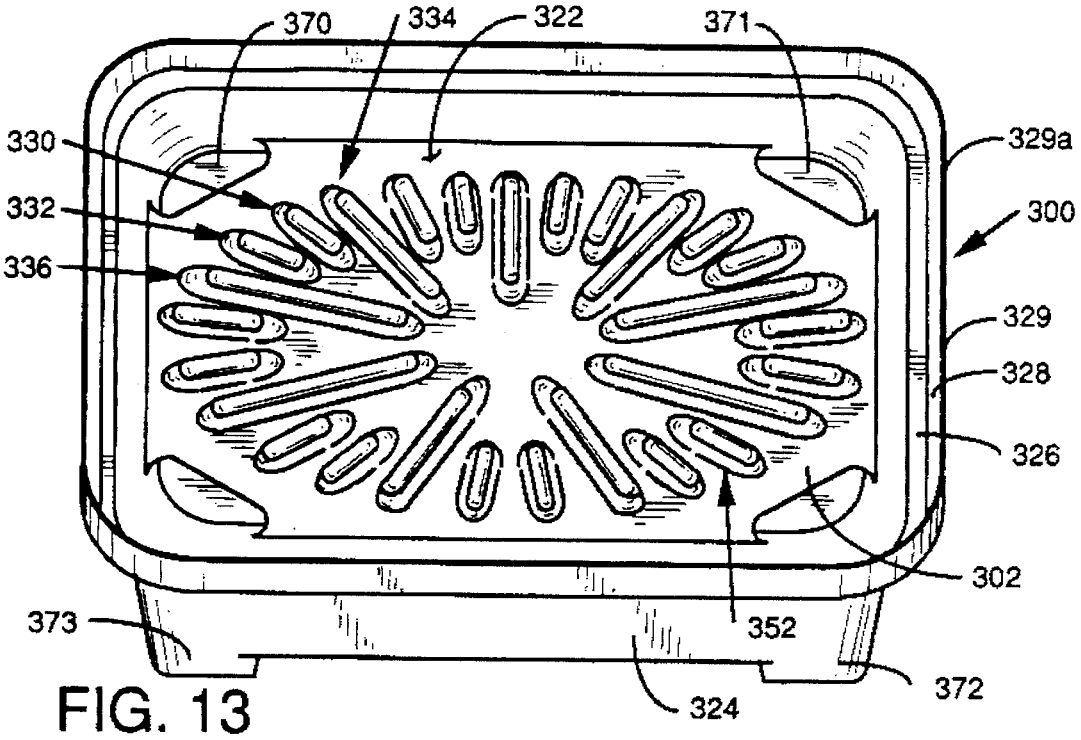
FIG. 13 is a perspective view of another embodiment of an ovenable food package.
Figure 14:
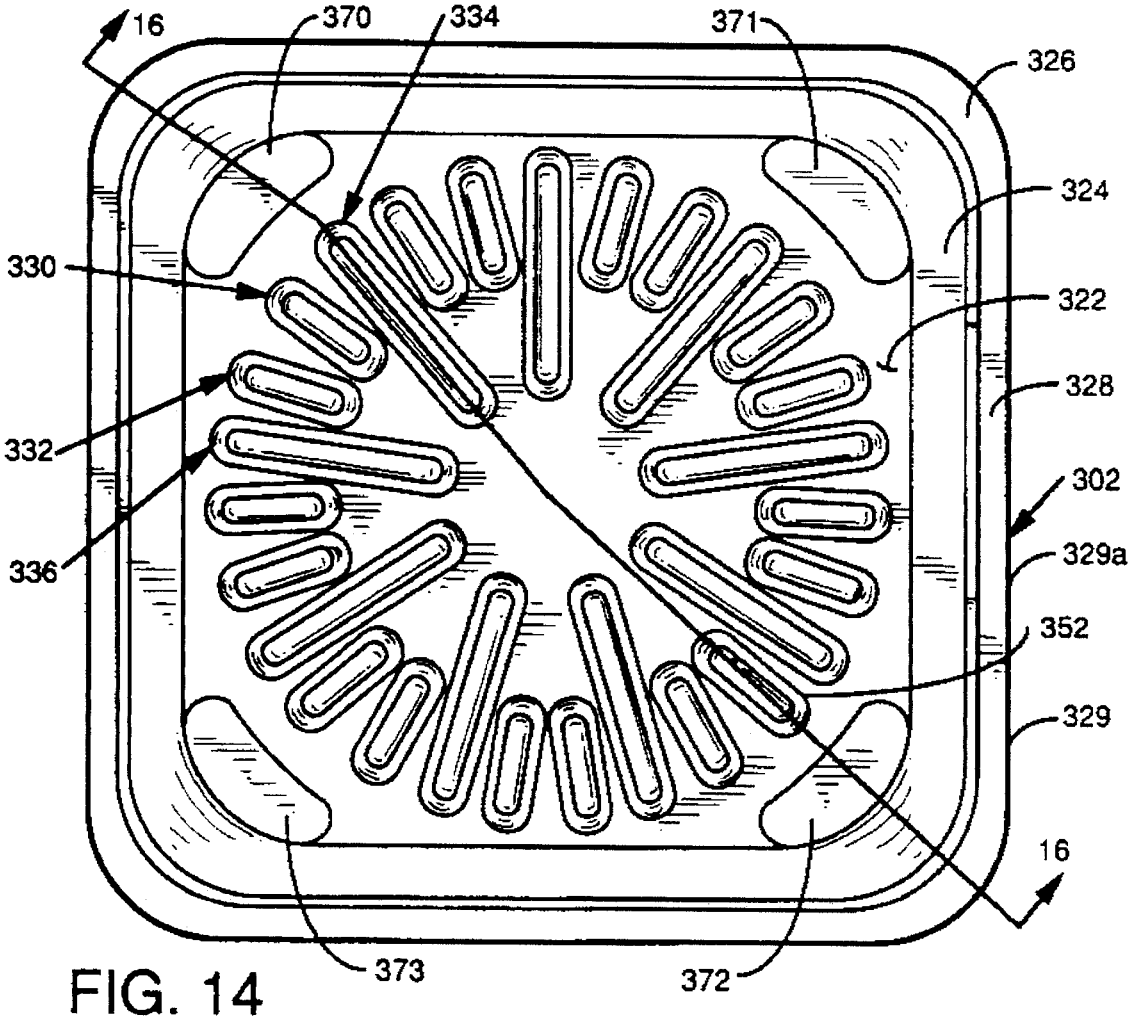
FIG. 14 is a top plan view of the package of FIG. 13.
Figure 15:
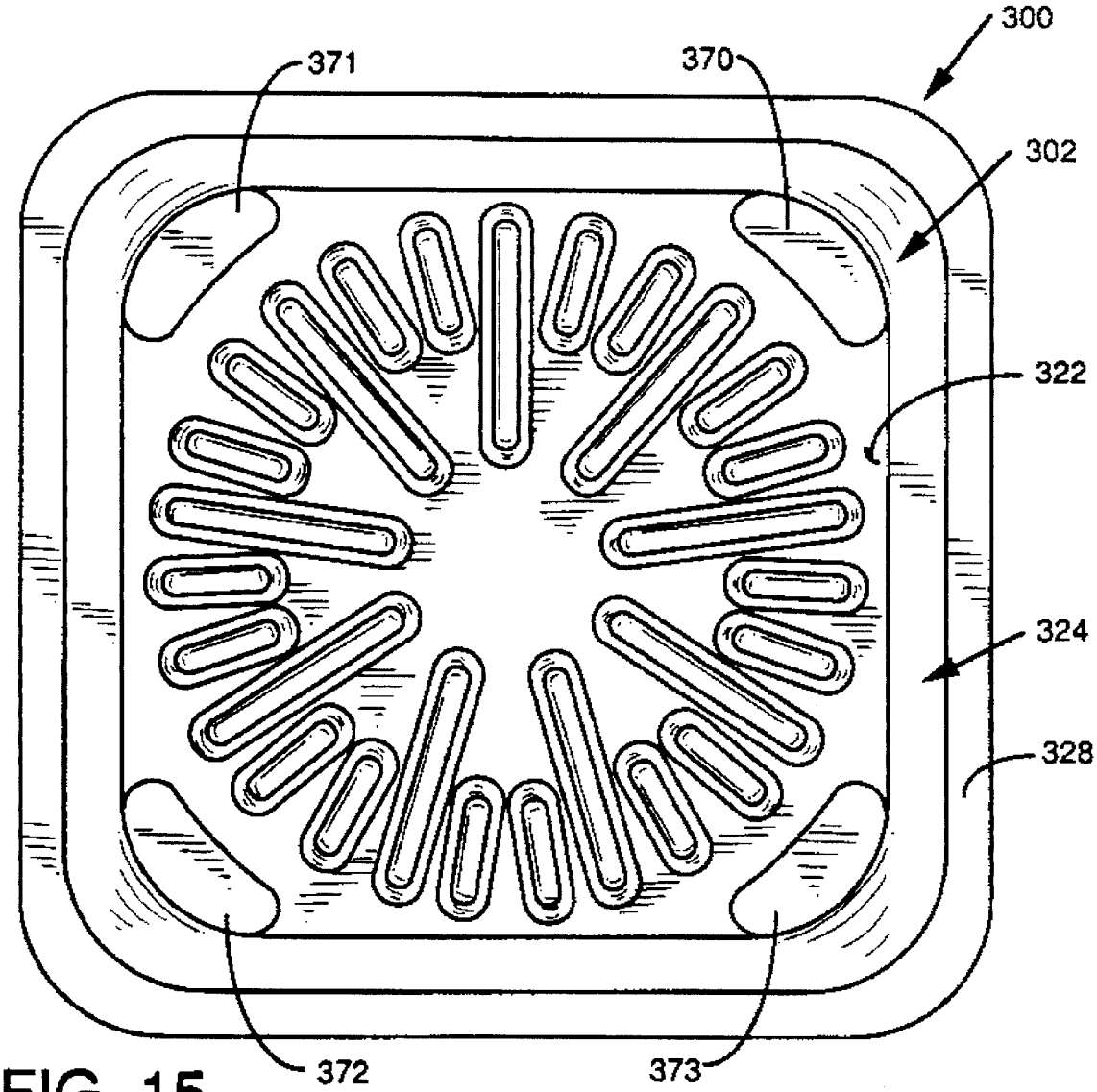
FIG. 15 is a bottom plan view of the package of FIG. 13.
Figure 16:
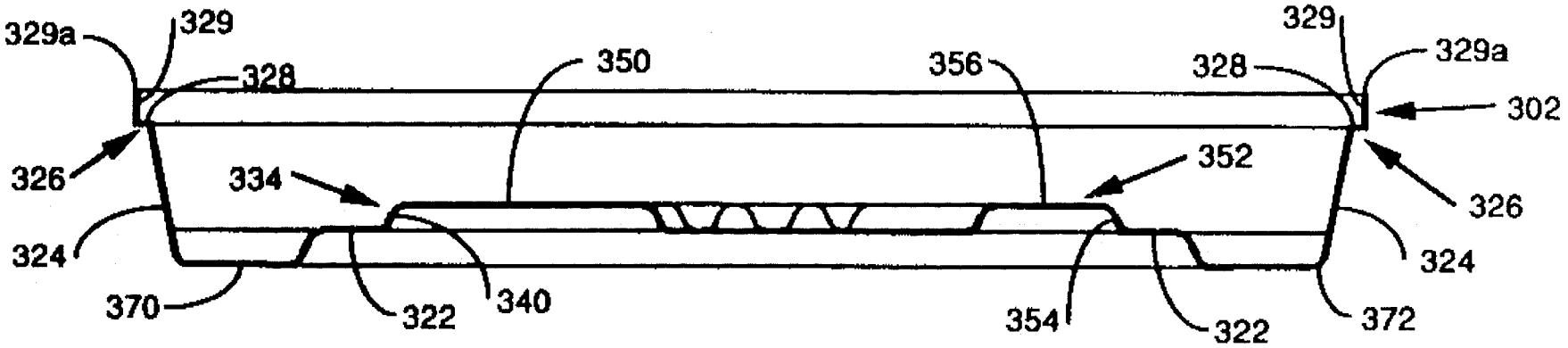
FIG. 16 is a sectional view taken through line 16—16 of FIG. 14.

The exterior gap 366 is created by a plurality of leg members, four of which, leg members 370, 371, 372 and 373 are shown in FIGS. 13–15. Preferably, the leg members 370, 371, 372 and 373 extend from the corners of the base 302 in order to maximize the exterior gap 366 created between the base 302 and the support surface 368 (FIG. 20) of the food heating apparatus. The leg members 370–373 are further preferably integrally formed in the base 302.

Referring again to FIG. 17, the lid means 400 of the invention will be described. The lid 400 is preferably made of paperboard coated with plastic and can be used with either a paperboard base or a C-PETE base. The lid means 400 is sized and shaped such that its edge portion 402 can be placed in intimate surface-to-surface contact with horizontal portion 328 of the stepped flange 326 which extends from the floor portion 322 of the base 302. As can be seen in FIG. 17, the lid 400 is initially placed on flange 326 with the aid of anvil 410 which supports the undersurface of horizontal portion 328 and which allows the lid 400 to be pressed down against the horizontal portion by mechanical means (not shown). Anvil 410 preferably surrounds the base 302. Once in position, the lid 400 is preferably heat welded to horizontal portion 328 with an apparatus and a method well known to those skilled in the art, such as a heating die. The base 302 which contains the food product is thus containerized and ready for final processing, such as freezing, and then shipment.

Figure 18:
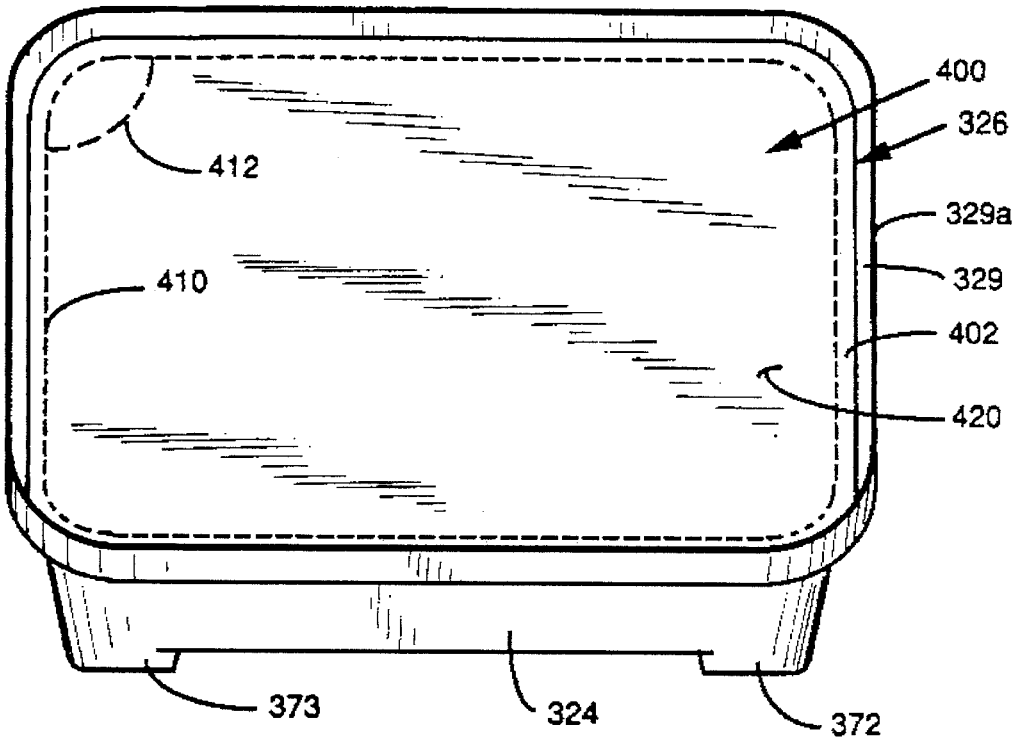
FIG. 18 is a detailed perspective view of the assembled food package of FIG. 17 showing the lid being in position on the base.

Referring to FIG. 18, the lid means 400 includes score lines 410 which facilitate removing a portion of the lid means 400 from the package. It is further preferred to provide a finger tab, defined by score lines 412. In use, a user breaks the score lines 412 and places a finger underneath the lid means 400 and pulls the lid means 400 away from the corner in which the score line 412 is disposed. Score line 410 then facilitates tearing of a portion of the lid means 400. Score lines 410 and 412 define a removable portion 420. The use of the removable portion 420 will be explained below with regard to FIGS. 19–20. The removable portion of the lid means is totally removed from the secured edge portions.

Figure 19:
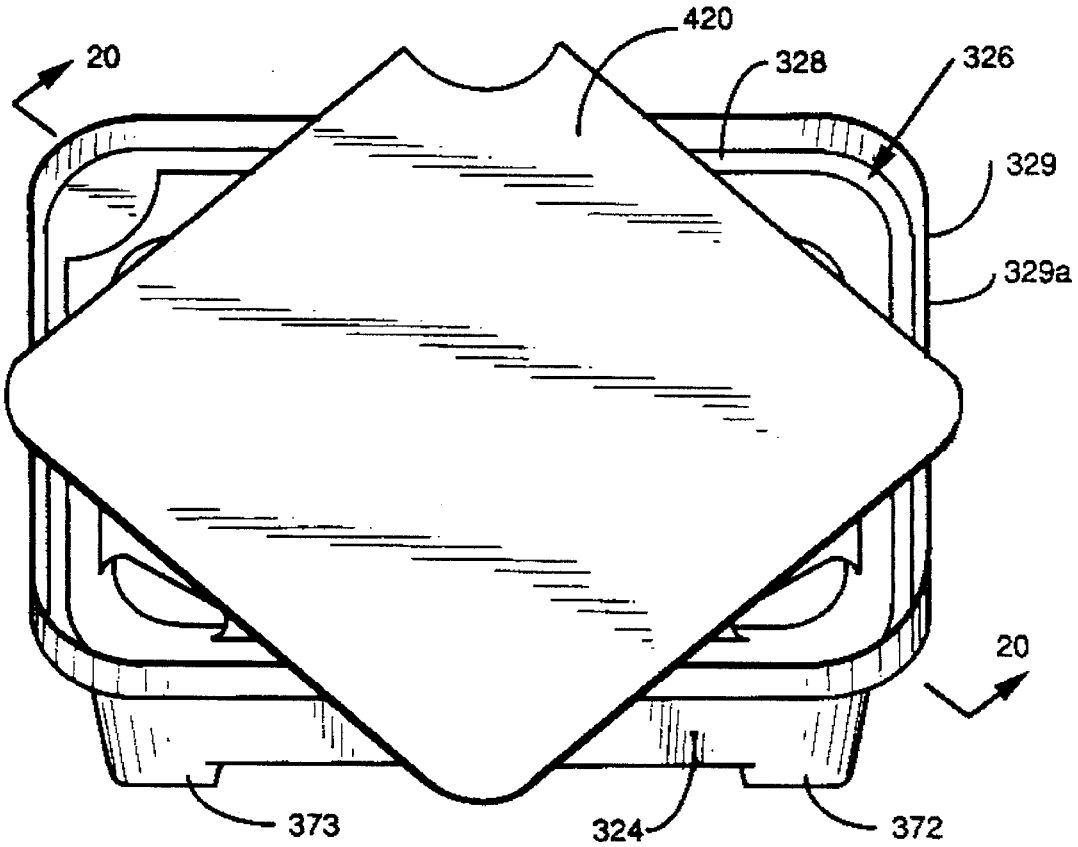
FIG. 19 is a detailed perspective view of the food package showing the lid after it is removed from the base and replaced onto the base so that the pizza is ready for cooking.
Figure 20:
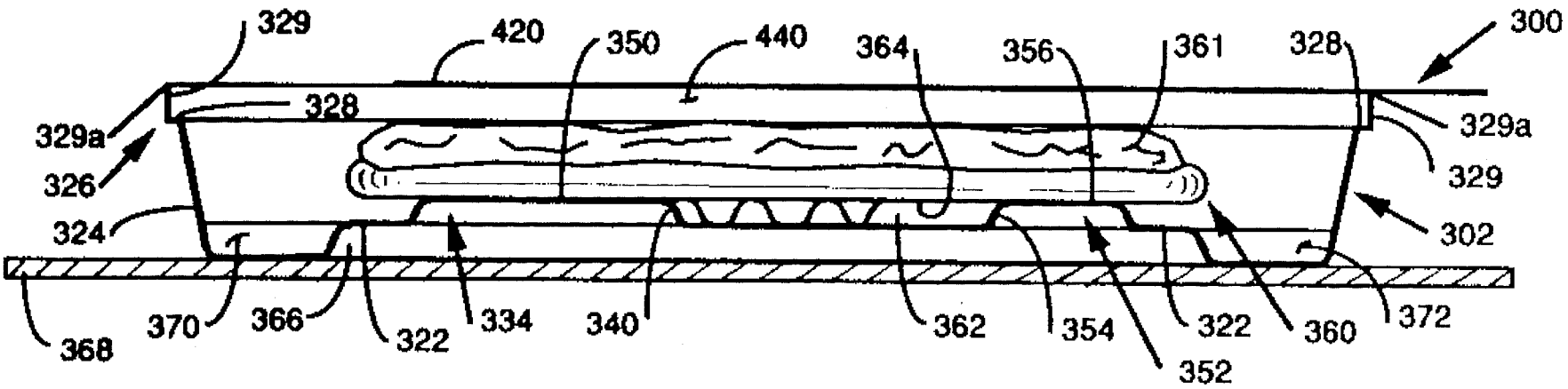
FIG. 20 is a cross-sectional view taken along line 20—20 of FIG. 19.

Referring now to FIGS. 19–20, once the removable portion 420 of the lid means is completely separated from the remainder of the lid means, it is positioned such that it rests on the free edge 329*a* of the vertical portion 329 of the stepped flange 326. It will be appreciated that the combination of the non-circular base and the non-circular removable portion 420 allows the non-circular removable portion 420 to be skewed from its original position so that it rests on the free edge 329*a* of vertical portion 329 and, as can best be seen in FIG. 20, creates a space 440 between the top of the pizza 360 and the removable portion 420 of the lid means. This space allows the steam to vent and also allows the steam to form a "steam blanket" in the space to enhance melting of the cheese on top of the pizza.

It will be appreciated that an ovenable food package has been disclosed which can be used in both conventional and microwave ovens and the like.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A package for containing a food product, said package supporting said food product when said food product is placed into a food heating apparatus having a support surface, said package comprising:

a non-circular base;

leg members extending from said base such that an exterior gap is created between a portion of said base and said support surface when said package is placed in said food heating apparatus;

a sidewall extending from said base, said sidewall having a stepped flange including a horizontal portion extending generally perpendicularly to said sidewall and a vertical portion extending generally perpendicularly to said horizontal portion, said vertical portion including a free edge; and lid means having edge portions secured to said horizontal portion of said stepped flange, at least a portion of said lid means being removable from said package, said removable portion being sized and shaped such that said removable portion can be positioned to rest on said free edge wherein a space is created between said lid means and said food product.

2. The package of claim 1, wherein said base is constructed and arranged such that at least one interior gap is created between said food product and said base when said food product is disposed on said base.

3. The package of claim 1, wherein said base is generally rectangular in shape; and said leg members extend from each of the corners of said base so that said portion of said base which is spaced from said support surface is maximized.

4. The package of claim 3, wherein said leg members are integrally formed with said base.

5. The package of claim 1, wherein said package is adapted for use in a microwave oven; and said base is made of paperboard having a high temperature polyester coating and further having a susceptor material sandwiched between said paperboard and said high temperature polyester coating.

6. The package of claim 5, wherein said lid is adapted for use in a microwave oven; and said lid is made of paperboard having a high temperature polyester coating.

7. The package of claim 1, wherein said base is made of C-PETE.

8. The package of claim 7, wherein said lid is made of paperboard having a high temperature polyester coating.

9. The package of claim 8, wherein said lid means is scored to facilitate removal of removable portion of said lid means.

10. The package of claim 9, wherein said scoring defines a finger tab to facilitate removal of said removable portion.

11. The package of claim 10, wherein said removable portion is non-circular.

* * * * *